US011866855B2

(12) United States Patent
Malina

(10) Patent No.: US 11,866,855 B2
(45) Date of Patent: Jan. 9, 2024

(54) SPINNING POSITION DEVICE WITH ENCAPSULATION

(71) Applicant: Saurer Intelligent Technology AG, Arbon (CH)

(72) Inventor: Ludek Malina, Kloten (CH)

(73) Assignee: Saurer Intelligent Technology AG, Arbon (CH)

( * ) Notice: Subject to any disclaimer, the term of this patent is extended or adjusted under 35 U.S.C. 154(b) by 0 days.

(21) Appl. No.: 17/823,977

(22) Filed: Sep. 1, 2022

(65) Prior Publication Data

US 2023/0228006 A1 Jul. 20, 2023

(30) Foreign Application Priority Data

Sep. 3, 2021 (CH) ..... 070240/2021

(51) Int. Cl.
*D01H 4/44* (2006.01)
*D01H 4/50* (2006.01)
*D01H 13/08* (2006.01)

(52) U.S. Cl.
CPC ..... *D01H 4/44* (2013.01); *D01H 4/50* (2013.01); *D01H 13/08* (2013.01)

(58) Field of Classification Search
CPC ..... D01H 1/16; D01H 1/162; D01H 1/42; D01H 4/44; D01H 13/08; D01H 11/00
See application file for complete search history.

(56) References Cited

U.S. PATENT DOCUMENTS

| | | | | | |
|---|---|---|---|---|---|
| 3,606,751 | A * | 9/1971 | Weller et al. | D01H 1/166 | 57/88 |
| 3,823,540 | A * | 7/1974 | Mandl | D01H 7/2225 | 57/88 |
| 3,879,926 | A * | 4/1975 | Bartling | D01H 4/44 | 57/263 |
| 3,973,381 | A * | 8/1976 | Teranishi | D01H 1/16 | 57/58.83 |
| 4,481,760 | A | 11/1984 | Stahlecker | | |
| 2002/0014065 | A1 * | 2/2002 | Pujol | D01H 1/36 | 57/75 |
| 2020/0392651 | A1 * | 12/2020 | Dreßen | D01H 1/16 | |

FOREIGN PATENT DOCUMENTS

| | | | | |
|---|---|---|---|---|
| CH | 492807 | A * | 6/1970 | D01H 7/2225 |
| DE | 3123887 | A1 | 1/1983 | |
| JP | S50141 | A | 1/1975 | |

* cited by examiner

*Primary Examiner* — Patrick J. Lynch
(74) *Attorney, Agent, or Firm* — Fox Rothschild LLP

(57) ABSTRACT

In a spinning position device (10) for a ring spinning machine (1) comprising a spindle (20) for a package body (13), which spindle (20) is rotatably mounted on a spindle rail (2), and an encapsulation (50) extending in the longitudinal direction of the spindle (20) and enclosing the package body (13), the encapsulation (50) being connected to the spindle rail (2), there is provision for the encapsulation (50) to be longitudinally divided and to have a rear encapsulation wall (51) and a front encapsulation wall (52), the front encapsulation wall (51) being movable into an open position, so that in the open position the package body (13) of the spinning position device (10) is accessible for operation.

16 Claims, 3 Drawing Sheets

SPINNING POSITION DEVICE WITH ENCAPSULATION

CROSS REFERENCE TO RELATED APPLICATIONS

This application claims, under 35 U.S.C. § 119(a), the benefit of Swiss Patent Application No. CH 070240/2021, filed on Sep. 3, 2021 in the Swiss Intellectual Property Office, the disclosure of which is incorporated herein by reference in its entirety.

TECHNICAL AREA

The invention relates to a spinning position device for a ring spinning machine comprising a spindle for a package body, which is rotatably drivably mounted on a spindle rail, and an encapsulation extending in the longitudinal direction of the spindle and enclosing the package body.

TECHNICAL BACKGROUND

Machines for closed-end spinning processes and true rotation, such as ring spinning, funnel spinning, loop spinning, spinning with rotating rings, spinning with floating rings, spinning with balloon limitations of all kinds (multi-balloon, stationary and mobile balloon control tubes, balloon reductions such as spinning crowns, spinning fingers, balloon control rings, etc.), pot spinning, Murano spinning, are generally known.

Such machines usually have a large number of spinning positions next to one another, which are moved in the same way or in a similar way to one another. These spinning processes can be used in the same way for twisting, although this will not be dealt with in any further detail. Thread is the generic term for yarn, filament and twisted yarn. "Yarn" and "spinning" are the terms that will be normally used below. However, the skilled person will be aware that the terms can also apply to "thread" and "twisting".

Already nowadays, many high-speed ring spinning machines are operated above the optimum speed in terms of costs, resulting from their production per spindle hour and energy consumption. Costs decrease linearly as production increases, and energy consumption increases exponentially with an exponent of about 2 to 4, usually about an exponent of 3.2 to 3.4.

The reason for the exponential increase in energy consumption is that in closed-end spinning processes with a single true twist, it is mandatory to rotate the take-up packages on the machine (otherwise, the machine would have to be rotated around the package). The package body, usually in the form of a cop, then acts as a fan.

Encapsulations for the purpose of saving energy by reducing the air mass to be accelerated, have been disclosed. In this case, the cop and/or the thread balloon is/are usually encapsulated by a cylindrical tube with a diameter that is several millimetres larger than the cop or the balloon. This works, but restricts the ability to access the cop in various operating situations, such as when piecing thread breaks or piecing.

A special form of balloon encapsulation is the balloon control tube, as described for example in DE1510657B1 or DE19848752A1.

The package or cop rotates on the axis of a spindle and is connected to it by frictional engagement, for example. The spindle can be driven by a belt drive or by a single motor. A large number of bearing variants exist, which should ideally be independent of the encapsulation. The spindles are usually fixed in a spindle rail. This can be fixed or movable in the axial direction of the spindle.

Furthermore, a relative movement in the axial direction of the package (or the spindle) must be realised between the latter and an element for defining the thread displacement, so that not all the yarn is wound up at the same position as a bead, but in a package build form that can be determined by the relative movement (e.g. as cop winding).

Elements for thread displacement are, for example, a ring and traveller, the cap or funnel edge in cap, funnel or loop spinning or a thread guide in funnel or Murano spinning, thread guide tubes or similar.

The elements for thread displacement are usually attached side by side to a long element which, depending on the element, is called a ring, funnel, cap or thread guide rail or frame, for example.

The relative movement can be realised by the movement of one or both elements in relation to one another. On widely used conventional ring spinning machines, the ring rail is moved and the spindle rail is fixed to the machine frame.

If a spindle is now encapsulated, either the relative movement of the thread displacement must be made possible in the encapsulated area, or a large part of the encapsulation must be dispensed with, and thus the energy saving is not realised.

Encapsulations can be attached to the ring rail as described in CH683349A5 (and DE1510657B1 or DE19848752A1), although here only a specific, small part of the spinning area is encapsulated. The energy saving is small in this case.

CN209957949U discloses an incomplete encapsulation that is attached below the ring rail, but shows an upwardly displaced, extended attachment of the spindle with a single-motor drive. The encapsulation is not complete and the spindle is relatively unstable, in which case the air gap of the external traveller cannot be kept constant due to the precession of the spindle.

CH706759A1 shows an encapsulation that completely and efficiently encapsulates the cop below the ring rail, although the drive and bearing construction of the spindle is unfavourably long, so as to allow the spindle to protrude into the encapsulation.

DE1685679A1 shows two different shortenable encapsulation variants, neither of which, however, has a diameter that is optimum in terms of energy along their entire length, nor are they stable, dirt-resistant and easy to clean. In addition, they do not offer easy accessibility.

EP3483313A1 describes a moving spindle rail, in which case the spindle moves into the encapsulation. Here, too, a complex, long spindle shape is necessary.

WO2020105006A1 describes a long magnetically mounted spindle that is suitable for entering an encapsulation that is attached to a ring rail. The complexity required to use encapsulation is considerable.

CH715908A1 disclosed a multiballoon process with a fixed ring rail and a moving spindle rail that allows the majority of balloons to be kept constant. However, it is also possible to appreciate the considerable complexity and enormous structural height required to encapsulate both the balloon above the ring rail and the cop below the spindle. Likewise, the energy saving is reduced due to the large volume of air rotated.

JP2013170337A describes a spinning machine in which the encapsulation is fixed to the spindle rail. The encapsulation is slotted, and the functional part of the ring rail is placed towards the inside of the machine, behind the encapsulation, so that the ring holder engages through the slot from the outside from the ring rail and the ring is guided inside the encapsulation in the axial direction. The machine structure is essentially conventional and the encapsulation is only as high as required by the function, but, among other disadvantages, the accessibility of the spinning position in particularly is poor. The spinning machine is difficult to operate in certain operating situations. In any case, the spinning position must be stopped and made accessible in certain operating situations, such as a thread break or when piecing onto the bare tube.

CN210194054U solves the problem of thread guide integration and guides the spinning ring by magnets held from outside within the encapsulation, without needing a slot. The thread guide is integrated into the cover and the structural height is optimised. The encapsulation rotates and would in turn require encapsulation to save energy. The technical complexity is considerable. The spinning position is very difficult to access.

During piecing on a conventional ring spinning machine, a thread piece already on the package or attached there for the purpose of piecing is threaded upwards through the thread guiding element(s), the spindle is started and the thread end is brought together with the fibres exiting the drafting system so that the new fibres are twisted together with the old yarn piece and are thus joined. This can be done, for example, by starting twisting at the drafting system outlet or by depositing at the outfeed roller. After that, the normal spinning process begins, during which the supplied fibres are given a certain number of twists per length of yarn.

However, it is essential for the spindle to be started with a finished twisted thread. During the remaining piecing process time, the thread is given additional twists into always the same yarn piece, which can lead to the thread being excessively twisted and thus breaking if the piecing is too slow or the spinning speed is too fast.

REPRESENTATION OF THE INVENTION

One task of the present invention is to provide a complete encapsulation of a spindle or a package body which allows a simple accessibility to the spindle and is compatible with the construction of a normal ring spinning machine. Another task is to enable accessibility with easy operation of a single spinning position, especially in the event of a thread break. In particular, it should be possible to piece a thread break in the 6 to 10 seconds that are usual today.

This task is accomplished by means of a spinning position device having the features of claim 1. The spinning position device for a ring spinning machine has a spindle for a package body (i.e. a bare tube or a package with a yarn wound on it), which spindle is rotatably drivably mounted on a spindle rail, and an encapsulation extending in the longitudinal direction of the spindle and enclosing the package body, the encapsulation being connected to the spindle rail. The encapsulation is divided in the longitudinal direction and has a rear encapsulation wall and a front encapsulation wall on the operator side. The front encapsulation wall is movable to an open position, so that in the open position the package body of the spinning position device is accessible for operation.

In some embodiments, the front encapsulation wall can be pivotally connected at a lower area and can be pivoted into a preferably horizontal position. Alternatively, the front encapsulation wall can be brought into an open position by a linear movement, by pivoting about the spindle axis, or by a sliding movement or the like.

The invention has the advantage that the encapsulation can be opened very easily. In a ring spinning machine, the rotary axes of the spindles run vertically in the individual spinning positions. The spindles are mounted on a spindle rail at the lower end so that they can be rotatably driven. As the front encapsulation wall on the operator side is rotatably mounted at the lower end, it is possible reliably to ensure accessibility to the package body from the front, i.e. from the operating side of the ring spinning machine, when swivelling out from a vertical, closed position into a horizontal, open position, so that mechanical piecing, or automatic or manual operation in the event of a thread break, is possible in a trouble-free manner. Such encapsulation is also suitable for retrofitting existing spinning machines.

In some embodiments, the rear encapsulation wall can be fixedly connected to the spindle rail and the front encapsulation wall can be pivotally connected to the rear encapsulation wall. For this purpose, the rear encapsulation wall can, for example, have two laterally arranged and forward-projecting legs on which the front encapsulation wall is held pivotably, e.g. by means of an axle. Alternatively, the front encapsulation wall can also be pivotably connected to the spindle rail, or to a retainer attached to the spindle rail.

In some embodiments, the rear encapsulation wall and the front encapsulation wall can each be formed as a partial shell, and are preferably connected to one another with a hinge in the area of the spindle rail. Together, the partial shells enclose 360° of the spindle axis. The partial shells can be designed as two half shells, each enclosing 180°. Other divisions are also conceivable.

In some embodiments, the spinning position device can further include a spindle brake that can be actuated by opening the encapsulation in order to brake the spindle or package body. Such a mechanical spindle brake is often necessary because the package bodies can no longer be braked by hand due to the high speed of rotation. Reliable fast deceleration is also necessary, for example, to piece a thread break in the shortest possible time.

Spindle brakes, in and of themselves, have already been disclosed, and are usually designed to be actuated by the operator with the knee, leaving both hands free to piece the thread break.

Now, in some embodiments, the front encapsulation wall can include a brake actuation device that actuates the spindle brake by moving the front encapsulation wall to the open position. This has the advantage that the spindle or package body is braked at the same time as the encapsulation is opened. Cumbersome braking with the aid of the knee can be dispensed with. As soon as the encapsulation is completely open, the package body is also braked and the yarn end can be threaded back in correctly, and connected to the sliver. When the encapsulation is closed, the spindle brake is released accordingly and the spinning process continues.

In some embodiments, the brake force of the spindle brake can be controlled, preferably in an infinitely variable manner. With a controllable brake force, the spindle can be braked quickly or slowly to a standstill as required. Conversely, the start-up of the spindle can be regulated by closing the encapsulation or the front encapsulation wall so that the spindle has the speed of rotation required for piecing.

In some embodiments, a brake effect of the spindle brake can increase as the degree of opening of the encapsulation increases to a maximum brake effect. By opening or swinging out the front encapsulation wall, the spindle brake can be actuated via the brake actuation device attached to the front encapsulation wall. The spindle brake and the brake actuation device can be designed in such a way that the brake effect increases as the degree of opening of the encapsulation increases. During opening, the spindle or the package body is braked. Conversely, when the encapsulation is closed, the brake effect decreases and the spindle or package body starts to rotate again. The front encapsulation wall acts like a brake lever to regulate the speed of the spindle. In this way, a start-up of the spindle can be regulated, especially when closing the encapsulation, so that the optimum speed for twisting in the yarn at the end of the thread break piecing is achieved. As soon as the encapsulation is completely closed, the spindle runs again at the operating speed and the spinning process continues.

In some embodiments, the spindle brake between the package body and the wharve or between the wharve and the package bearing can be disposed with.

In some embodiments, the spindle brake can be in the form of a clamp or calliper. The clamp can include a first brake lever and a second brake lever connected to one another by a hinge. One of the brake levers can also be spring-loaded. A clamping jaw for braking the spindle can be formed at one end of each of the two brake levers, which are placed around the spindle for this purpose. The other end of the two brake levers in each case can be configured so that the brake actuation device can be inserted between the two brake levers and push these ends of the brake levers apart. In the process, the clamping jaws are pressed together and brake the spindle.

In the case of a spindle brake in the form of a clamp or calliper, the two brake levers at the end into which the brake actuation device is inserted (i.e. the end remote from the spindle) can have inclined stop surfaces that converge toward the hinge. In this way, the brake effect can increase with increasing opening of the encapsulation or increasing insertion of the brake actuation device between the brake levers. From a predetermined insertion depth, the two stop surfaces can be parallel to one another, so that if the brake actuation device is inserted even further, the brake effect no longer increases but remains maintained. This is particularly advantageous if a spindle decoupling device described below is also used.

Other embodiments of the spindle brake with, for example, a brake pad and a slotted guide for a brake actuation device of the encapsulation are also possible. The slotted guide can be designed in such a way that the brake effect increases as a function of the degree of opening of the encapsulation and, if necessary, is kept constant from a certain degree of opening.

Spinning position devices can be provided with individual spindle drive units, or one drive unit can drive several spinning position devices via a drive belt, for example.

In some embodiments, the spinning position device can include an individual spindle drive unit that can be controlled by opening or closing the encapsulation (similar to the spindle brake described above). For this purpose, the spinning position device can be provided with a drive control unit that can be actuated by opening and closing the encapsulation. By opening the encapsulation, the speed of the drive device can be reduced or the drive device can be switched off completely. Conversely, by closing the encapsulation, the speed of the drive device can be increased or the drive device can be switched on again. The controller can be mechanical and/or electronic.

In some embodiments, the spinning position device can include a spindle decoupling device that decouples a drive element of the ring spinning machine from the spindle by opening the encapsulation, preferably when the front encapsulation wall is swung out to the open position. The drive element can be a drive belt, which is applied to a wharve of the spindle to operate the spindle. Such a spindle decoupling device is advantageous in order to avoid overheating of the braked spindle by, for example, a drive belt that continues to run.

In some embodiments, the spindle decoupling device can have a decoupling roller that can be supported for movement in the direction of the drive belt in such a way that the decoupling roller pushes the drive belt away from the wharve when the spindle decoupling device is actuated. When the encapsulation is opened, the drive belt is decoupled from the spindle accordingly and the spindle can be braked more easily.

Decoupling or switching off a drive unit is particularly advantageous if the spinning position has to remain stationary for a relatively long period due to a defect.

In some embodiments, the spindle brake and the spindle decoupling device or drive control unit can be combined. Preferably, the spindle brake and the spindle decoupling device or the drive control unit can be designed in such a way that when the encapsulation is opened, preferably when the front encapsulation wall is swung out into the open position, first the spindle brake is actuated to the maximum brake effect and then only the drive element of the ring spinning machine is decoupled from the spindle. Conversely, the spindle brake and the spindle decoupling device or the drive control unit can be designed in such a way that, by closing the encapsulation, the drive element of the ring spinning machine is first coupled to the spindle before the spindle brake is subsequently released.

In some embodiments, the front encapsulation wall can include an actuation arm for actuating the spindle decoupling device or the drive control unit. The decoupling roller can, for example, be mounted on a horizontally guided slide, in which case the slide can be operated by means of a knee lever. The actuation arm can act on the knee lever when the front encapsulation wall is swung out, thus decoupling the drive element. The actuation arm can be designed in such a way that it does not act on the spindle decoupling device until the encapsulation is almost completely open, so that the spindle is not decoupled until it has been braked. This is particularly advantageous so that when the encapsulation is closed, the spindle is first coupled to the drive element before the brake effect is released, in order to allow reliable regulation of the brake effect or gradual release of the brake effect during closing.

The combination of the encapsulation with the spindle brake, which can be adjusted as a function of the degree of opening of the encapsulation, can also be regarded as an independent invention. Likewise, the gradual regulation of the spindle brake itself can be considered an independent invention. The spindle decoupling device alone or in combination with the encapsulation with or without spindle brake can also be considered as an independent invention.

Likewise, another form of the invention is conceivable in which a mechanical brake (fast, powerful brake effect) or drive control acts on a spindle driven by an individual motor.

However, common to all embodiments is the braking of the spindle by the opening of the encapsulation of the spinning position and the controllable speed of the spindle at least during the run-up determined by the opening state of the encapsulation.

The invention further relates to a ring spinning machine having a plurality of the spinning position devices described above.

BRIEF EXPLANATION OF THE FIGURES

The invention should be explained in more detail below by means of embodiment examples in connection with the drawing(s). In the drawings.

In the figures, the same reference signs have been used for the same elements in each case, and explanations provided on the first occasion apply to all figures unless expressly stated otherwise.

WAYS TO CARRY OUT THE INVENTION

Figure 1A:
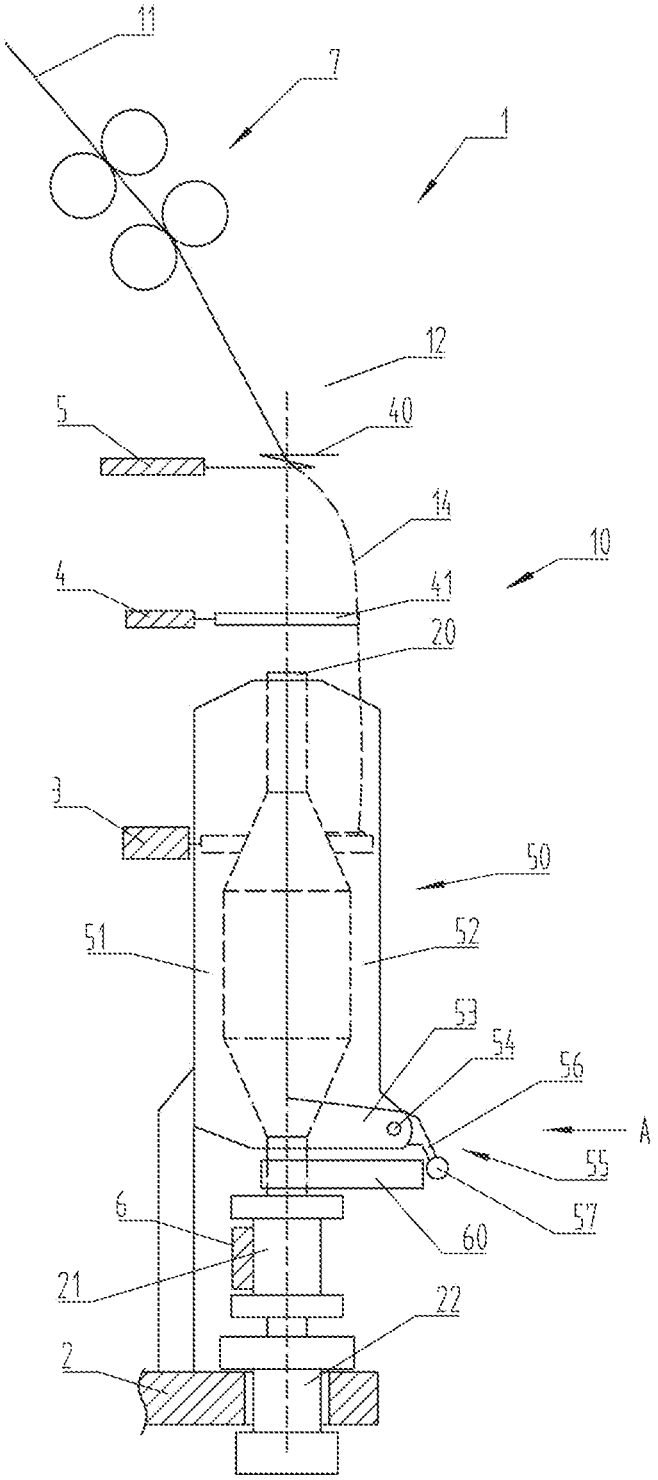
FIG. 1A shows a side view of a spinning position device with an encapsulation in a closed position.
Figure 1B:
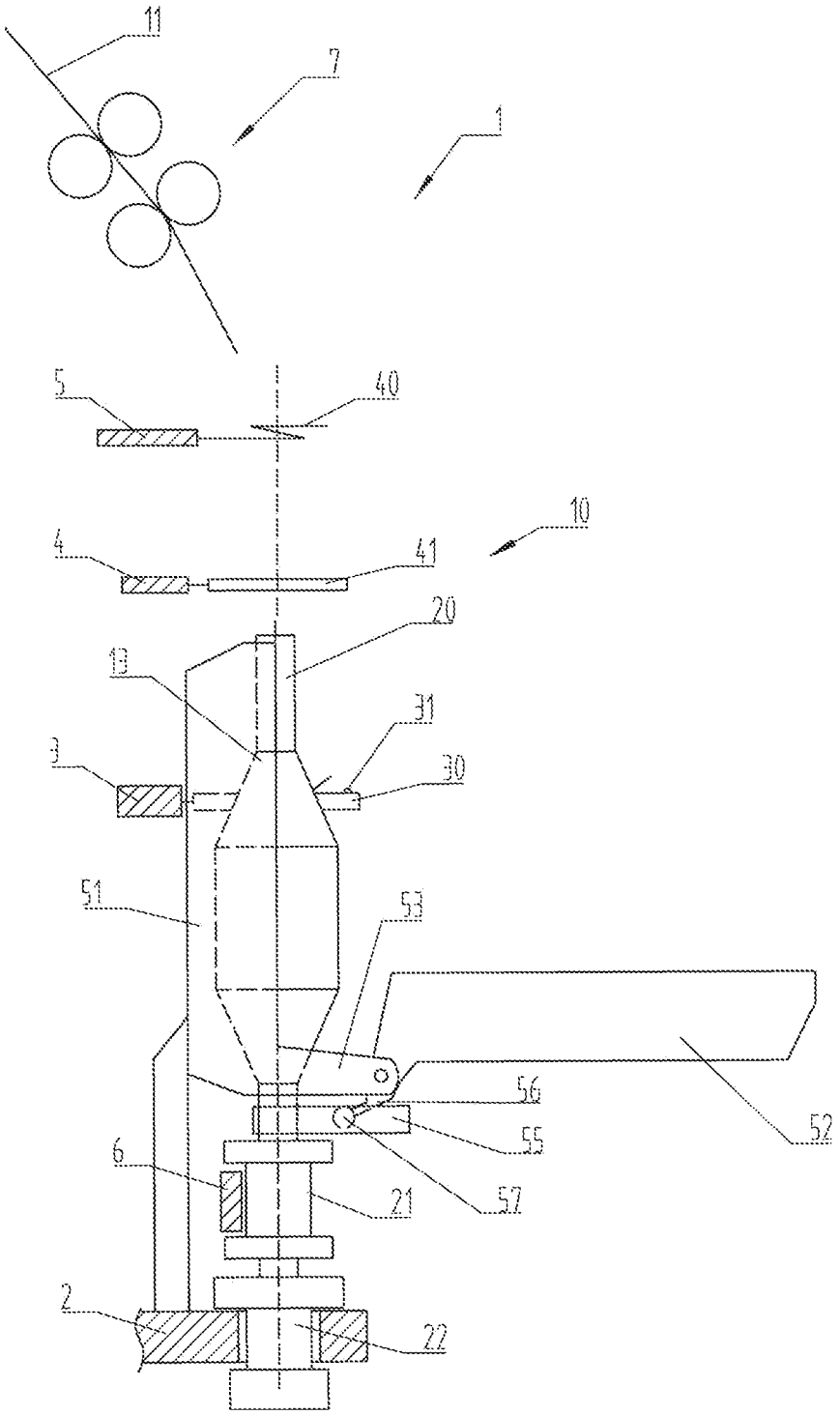
FIG. 1B shows a side view of a spinning position device with an encapsulation in an open position.

FIG. 1 shows a schematic representation of a spinning position 10 of a ring spinning machine 1 in a side view, under FIG. 1A with an encapsulation in a closed position and under FIG. 1B with an encapsulation in an open position.

At the spinning position 10, a yarn 12 is spun from a sliver 11 and wound onto a rotating package body 13 or a spinning cop. The package body 13 is mounted on a rotatably driveable spindle 20 for this purpose. During the spinning process, the sliver 11 passes through a drafting system 7, is then twisted into a yarn 12 and wound onto the package body 13. In order for the yarn 12 to be placed on the package body 13, the yarn 12 is guided through a ring traveller 31 rotating on a spinning ring 30. For guiding the yarn 12, a thread guide 40 is arranged further above the spindle 20 or the package body 13. The radial expansion of a thread balloon 14 forming during winding can be limited by a balloon limiter 41 or a balloon control ring. The balloon limiter 41 is then arranged between the spinning ring 30 and the thread guide 40. The ring spinning machine 1 typically possesses a plurality of spinning positions 10 arranged adjacent to one another.

The spinning rings 30 of the spinning positions 10 are arranged on a ring rail 3 extending in the longitudinal direction of the ring spinning machine 1. The balloon limiters 41 of the spinning positions 10 adjacent to one another are adjustably arranged on a crossmember 4 extending in the longitudinal direction of the ring spinning machine 1. Accordingly, the thread guides 40 of the spinning positions 10 arranged adjacent to one another are adjustably arranged on a crossmember 5 extending in the longitudinal direction of the ring spinning machine 1.

The spindles 20 of the spinning positions 10 are arranged on a spindle rail 2 extending in the longitudinal direction of the ring spinning machine 1. The spindle 20 of the spinning position 10 shown in the embodiment has a wharve 21 and a spindle bearing 22 at a lower end, by means of which the spindle 20 is rotatably mounted on the spindle rail 2. The spindle 20 is driven by a tangential belt 6, which can drive several spinning positions and is pressed against the wharve 21 of the spindle 20. Other drives are also possible.

FIG. 1A further shows an encapsulation 50 of the spinning position device 10 in a closed position.

The encapsulation 50 is formed from two encapsulation walls divided in the axial direction in the form of partial shells. A rear encapsulation wall 51 is connected to the spindle rail 2 and is fixedly attached or fixedly but removably attached relative to the spindle. A front, operator-side encapsulation wall 52 can be opened, for example, by pivoting about a hinge 54 with an axis lying in a plane perpendicular to the spindle or encapsulation axis. In the embodiment shown, the hinge 54 is located on two lateral legs 53 of the rear encapsulation wall 51 which protrude forward beyond the front encapsulation wall 52.

Further, a spindle brake 60 is shown schematically in the illustrated embodiment, which is arranged here directly below the package body 13 and above the wharve 21 of the spindle 20.

The front encapsulation wall 52 has a brake actuation device 55 to activate and control the spindle brake 60. This is realised here in the form of an actuation arm 56 with a ball 57 formed at its free end.

The front encapsulation wall 52 has a defined end position in the closed state. Means are provided for moving the thread displacement in the axial direction of the spindle 20 or package body 13, e.g. in the form of a spinning ring 30 and a ring traveller 31. This can be a slot with a ring holder, for example, in the rear encapsulation wall 51 or, for example, a magnetic guide of the spinning ring 30.

FIG. 1B shows the spinning position device of FIG. 1A with the encapsulation 50 in an open position. In this case, the front encapsulation wall 52 is pivoted forward and downward about the hinge 54 so that the front encapsulation wall 52 is in a substantially horizontal position. In this way, the package body 13 is freely accessible for operation. The front encapsulation wall 52 can be easily moved by hand (or by means of a robot) from the closed position to the open position.

The brake actuation device 55 is located at the lower end of the front encapsulation wall 52. When the front encapsulation wall 52 swings out, the brake actuation device 55—in the embodiment shown, the ball 57 of the brake actuation device 55—is inserted into the spindle brake, causing the spindle to be braked. Other embodiments of the brake actuation device are also possible.

Figure 2:
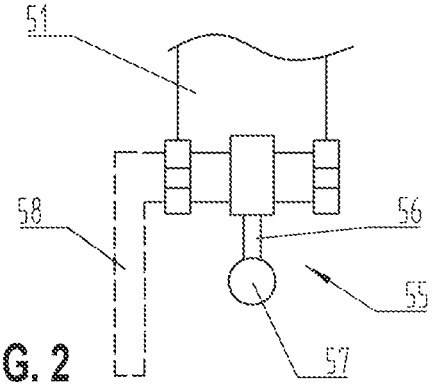
FIG. 2 shows a front view of the front encapsulation wall with a brake actuation device.

FIG. 2 shows a front view of the front encapsulation wall 52 with the brake actuation device 55 configured as an actuation arm 56 and ball 57.

Figure 3:
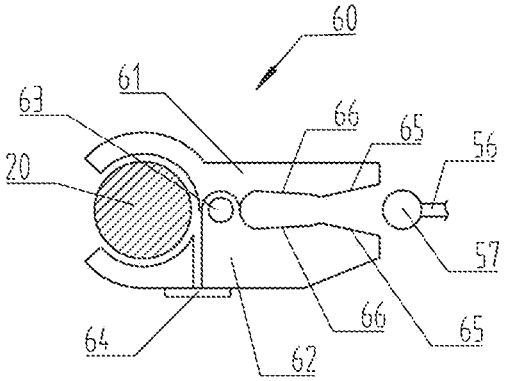
FIG. 3 shows a spindle brake.

FIG. 3 shows a top view of a spindle brake 60. In the embodiment shown, the spindle brake 60 takes the form of a clamp or calliper and includes a first brake lever 61 and a second brake lever 62. Both brake levers 61, 62 are connected to one another by a hinge 63. At one end, the two brake levers 61, 62 each have a brake or clamping jaw which is placed around the spindle 20 of the spinning position device 10. When the spindle brake 60 is actuated, the clamping jaws are pressed against the spindle 20 and brake it.

The other end of the two brake levers 61, 62 in each case is configured so that the brake actuation device 55 can be inserted between the two brake levers 61, 62 and push these ends of the brake levers 61, 62 apart. In the process, the clamping jaws are pressed together and brake the spindle.

Thus, the spindle brake 60 can be actuated by a suitable brake actuation device 55, for example in the form of a wedge, a ball 57, a cylinder or other suitable shape, and its brake force can be infinitely variably controlled or regulated. The gap shown between the brake levers 61, 62 is wedge-shaped and straight, although the wedge shape can have a different angle or any wedge-shaped curve contour to allow the brake effect to be adjusted depending on the travel or pivot angle of the actuation.

One of the brake levers—in this case the second brake lever 62—is spring-loaded, for example by having two parts connected by a spring element 64. The spring element 64 can be a piece of spring steel.

As the front encapsulation wall 52 pivots out, the ball 57 of the brake actuation device 55 is inserted deeper and deeper into the gap between the two brake levers 61, 62. In order to gradually increase the brake effect as a function of the degree of opening of the encapsulation 50, the two brake levers 61, 62 each have stop surfaces 65 for the ball 57 of the brake actuation device 55 at the end facing away from the spindle, which surfaces 65 come closer to one another towards the hinge 63 so that a tapering gap is formed between the brake levers 61, 62 into which the ball 57 is inserted. As the depth of insertion increases, the ends of the spindle brake 60 facing away from the spindle are forced apart and the clamping jaws are pressed against the spindle 20. The brake effect increases in the process.

Above a certain depth of insertion, the brake levers can have stop surfaces 66 for a constant maintained brake effect, which are substantially parallel to one another when the brake actuation device 55 is inserted. In this way, the encapsulation 50 can be moved to the fully open position after it has already produced the maximum brake effect in a partially open position. The brake effect is kept constant in this case.

In other words, opening the encapsulation 50 accordingly guides the brake actuation device 55 to a certain depth of insertion at the stop surfaces 65 for increasing brake effect. It is then guided on the stop surfaces 66 until the encapsulation is fully opened for a constantly maintained brake effect. In this way, the spindle brake can be easily adjusted by swinging the front encapsulation wall 52 out or in. This is particularly advantageous if a spindle decoupling device 70 is also used, as described below under FIG. 4.

Further, a detent position is provided to allow the spindle brake 60 to be held closed without the brake actuation device 55 having to be held. This can be formed centrally in the gap or at its end. A variety of embodiments are also conceivable for this.

The brake is designed here as a "calliper" that closes when the two actuating levers are pushed apart and does not touch the spindle during its normal operation. For this purpose, a spring is provided to move and hold the brake calliper in this position, although this can also be achieved by a number of other embodiments of the calliper. For example, the same function can be performed by an elastomer or by having the calliper configured as a plastic part that is elastic at least in parts.

Alternatively, the spindle brake can be designed to close when the brake levers are pressed together. The brake levers must then be compressed by a suitable counterpart of the brake actuation device. For example, the wedge shape of the gap of the brake levers can likewise be integrated into the brake actuation device. Likewise, one of the brake levers or only one brake pad can be fixed and only one brake lever is actuated.

Figure 4A:
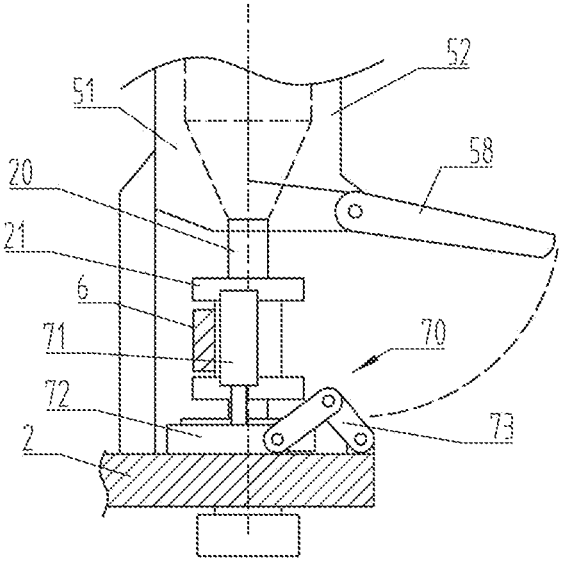
FIG. 4A shows a spindle decoupling device in a coupled position.
Figure 4B:
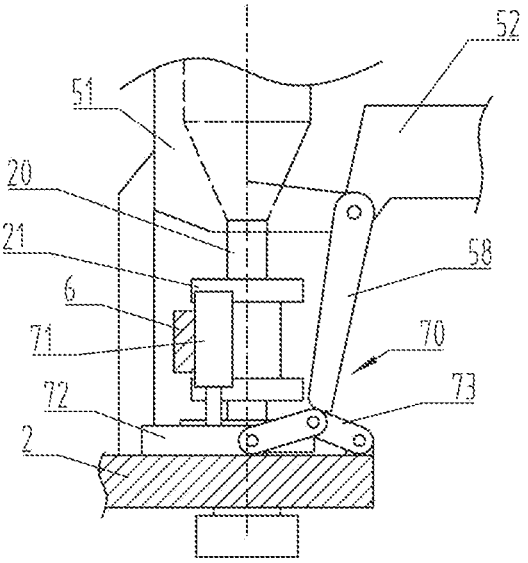
FIG. 4B shows a spindle decoupling device in a decoupled position.

FIG. 4 shows a schematic view of a spindle decoupling device 70 under FIG. 4A in a coupled position and under FIG. 4B in a decoupled position. In this case, the front encapsulation wall 52 has a fixed actuation arm 58 for the spindle decoupling device 70. In FIG. 2, the actuation arm 58 for the spindle decoupling device 70 is shown with dashed lines. This is offset from the spindle 20 in the horizontal longitudinal direction of the ring spinning machine so that it can actuate the spindle decoupling device 70 arranged next to the spindle 20.

In the embodiment shown, the spindle decoupling device 70 has a slide 72 guided linearly on the spindle rail 2. A decoupling roller 71 with a vertical axis of rotation is mounted on the slide 72 (the rotary axis is parallel to the spindle axis). The slide 72 is connected to the spindle rail 2 or a guide plate for the slide 72 via a knee lever 73. Actuation of the knee lever 73 results in a linear displacement of the slide 72 with the decoupling roller 71.

The spindle decoupling device 70 is arranged in such a way that the decoupling roller 71 lifts the drive belt 6 off the spindle 20 (or the wharve 21 of the spindle 20) when the knee lever 73 is actuated (see FIG. 4B), in order to prevent the spindle 20 from becoming hot in the braked state. This is particularly advantageous for higher spindle speeds and greater power transmission.

For actuating the knee lever 73 or the spindle decoupling device 70, the front encapsulation wall 52 has an actuation arm or actuating lever 58 connected in a rotationally fixed manner. When the actuation arm 58 is removed from the knee lever 73, the drive belt 6 returns the decoupling roller 71, the slide 72 and the knee lever 73 to the initial position. The process can be supported by a suitable mechanism, e.g. by a spring or the like, and the movements can be limited so that the end positions are defined but the slide 72 is removable.

Likewise, other actuation mechanisms of the decoupling roller, such as eccentrics or partial eccentrics, are conceivable to disengage the decoupling roller. What all solutions have in common, however, is the lifting of the drive belt from the spindle.

LIST OF REFERENCE SIGNS

1 Ring spinning machine
2 Spindle rail
3 Ring rail
4 Crossmember (balloon limiter)
5 Crossmember (thread guide)
6 Drive element/tangential belt
7 Drafting system
10 Spinning position/spinning position device
11 Sliver
12 Yarn
13 Package body/spinning cop
14 Thread balloon
20 Spindle
21 Wharve
22 Spindle bearing
30 Spinning ring
31 Ring traveller
40 Thread guide
41 Balloon limiter
50 Encapsulation
51 Rear encapsulation wall
52 Front encapsulation wall
53 Leg
54 Hinge/rotary axis
55 Brake actuation device
56 Actuation arm
57 Ball
58 Actuation arm for spindle decoupling device
60 Spindle brake
61 First brake lever
62 Second brake lever
63 Hinge
64 Spring element
65 Stop surface for increasing brake effect

66 Stop surface for constant brake effect
70 Spindle decoupling device
71 Decoupling roller
72 Slide
73 Knee lever

The invention claimed is:

1. A spinning position device (10) for a ring spinning machine (1), comprising:

a spindle (20) for a package body (13), rotatably mounted on a spindle rail (2); and an encapsulation (50), extending in a longitudinal direction of the spindle (20) and enclosing the package body (13), wherein the encapsulation (50):

is connected to the spindle rail (2), is longitudinally divided; and has a rear encapsulation wall (51) and a front encapsulation wall (52), wherein the front encapsulation wall (52) is configured to be movable into an open position, so that, in the open position, the package body (13) is accessible for operation, wherein the spinning position device (10) further comprises a spindle brake (60) configured to be actuated by opening the encapsulation (50) in order to brake the spindle (20) or package body (13), wherein the spinning position device (10) for the ring spinning machine comprises a spindle decoupling device (70) configured to decouple a drive element (6) of the ring spinning machine (1) from the spindle (20) by opening the encapsulation (50), and when the encapsulation (50) is closed, the drive element (6) of the ring spinning machine (1) is configured to be coupled to the spindle (20) before the spindle brake (60) is subsequently released, and wherein the spindle brake (60) is configured such that a brake force of the spindle brake (60) can be controlled in a variable manner.

2. The spinning position device according to claim 1, wherein the front encapsulation wall:

is pivotably connected at a lower area; and is configured to be pivoted into a horizontal position.

3. The spinning position device according to claim 2, wherein:

the rear encapsulation wall (51) is fixedly connected to the spindle rail (2), and the front encapsulation wall (52) is pivotally connected to the rear encapsulation wall (51).

4. The spinning position device according claim 1, wherein the rear encapsulation wall (51) and the front encapsulation wall (52) are each formed as a partial shell, and are connected to one another with a hinge (54) in an area of the spindle rail (2).

5. The spinning position device according to claim 4, wherein the front encapsulation wall (52) comprises a brake actuation device (55) configured to actuate the spindle brake (60) by moving the front encapsulation wall (52) to the open position.

6. The spinning position device according to claim 4, wherein the spindle brake (60) is configured such that a brake effect of the spindle brake (60) increases with increasing degree of opening of the encapsulation (50), up to a maximum brake effect.

7. The spinning position device according to claim 4, wherein the spindle brake (60) is configured in the form of a calliper.

8. The spinning position device according to claim 1, further comprising an individual spindle drive unit which is configured to be controllable by opening and/or closing the encapsulation (50).

9. The spinning position device according to claim 1, wherein the drive element (6) comprises a drive belt configured to abut against a wharve (21) of the spindle (20) for operating the spindle (20).

10. The spinning position device according to claim 9, wherein the spindle decoupling device (70) comprises a decoupling roller (71) configured to be movably mounted in a direction of the drive belt (6), so that the decoupling roller (71) pushes the drive belt (6) away from the wharve (21) when the spindle decoupling device (70) is actuated.

11. The spinning position device according to claim 1, wherein the spindle brake (60) and the spindle decoupling device (70) are configured such that, when the encapsulation (50) is opened:

the spindle brake is configured to be actuated to a maximum brake effect; and the drive element (6) of the ring spinning machine (1) is then configured to be decoupled from the spindle (20).

12. The spinning position device according to claim 1, wherein the front encapsulation wall (52) comprises an actuation arm (58) configured to actuate the spindle decoupling device (70).

13. The spinning position device according to claim 10, wherein the decoupling roller (71) is mounted on a horizontally guided slide (72), wherein the slide (72) is configured to be operable by means of a knee lever (73).

14. A ring spinning machine (1), comprising:

a plurality of spinning position devices (10), wherein each spinning position device (10) of the plurality of spinning position devices (10) comprises:

a spindle (20) for a package body (13), rotatably mounted on a spindle rail (2); and an encapsulation (50), extending in a longitudinal direction of the spindle (20) and enclosing the package body (13), wherein the encapsulation (50):

is connected to the spindle rail (2), is longitudinally divided; and has a rear encapsulation wall (51) and a front encapsulation wall (52), wherein the front encapsulation wall (52) is configured to be movable into an open position, so that, in the open position, the package body (13) is accessible for operation, wherein each spinning position device (10) of the plurality of spinning position devices (10) further comprises a spindle brake (60) configured to be actuated by opening the encapsulation (50) in order to brake the spindle (20) or package body (13), wherein each spinning position device (10) comprises a spindle decoupling device (70) configured to decouple a drive element (6) of the ring spinning machine (1) from the spindle (20) by opening the encapsulation (50), and when the encapsulation (50) is closed, the drive element (6) of the ring spinning machine (1) is configured to be coupled to the spindle (20) before the spindle brake (60) is subsequently released, and wherein the spindle brake (60) is configured such that a brake force of the spindle brake (60) can be controlled in a variable manner.

15. The ring spinning machine according to claim 14, wherein, for each spinning position device (10) of the plurality of spinning position devices (10), the front encapsulation wall:

is pivotably connected at a lower area; and is configured to be pivoted into a horizontal position.

16. The ring spinning machine according to claim 15, wherein, for each spinning position device (10) of the plurality of spinning position devices (10):

the rear encapsulation wall (51) is fixedly connected to the spindle rail (2), and the front encapsulation wall (52) is pivotally connected to the rear encapsulation wall (51).

* * * * *